United States Patent [19]

Van Noord

[11] Patent Number: 4,580,778

[45] Date of Patent: Apr. 8, 1986

[54] PORTABLE EXERCISING APPARATUS WITH FORCE GAUGE

[76] Inventor: Andrew J. Van Noord, 1434 Hillsboro, SE., Grand Rapids, Mich. 49506

[21] Appl. No.: 588,755

[22] Filed: Mar. 12, 1984

[51] Int. Cl.[4] ..... A63B 21/00

[52] U.S. Cl. ..... 272/131; 272/135; 272/DIG. 5; 73/381

[58] Field of Search ..... 272/131, 132, 141, 142, 272/DIG. 5, 67, 116, 133, 135, 136, 137, 138, 139, 140; 73/379, 380, 381

[56] References Cited

U.S. PATENT DOCUMENTS

| | | | |
|---|---|---|---|
| 468,154 | 2/1892 | McClure | 272/DIG. 5 X |
| 818,242 | 4/1906 | Geisel | 272/141 |
| 2,307,856 | 1/1943 | Porter | 272/131 |
| 2,680,067 | 6/1954 | Newman | 272/DIG. 5 X |
| 3,216,259 | 11/1965 | Bendix | 272/DIG. 5 X |
| 3,971,255 | 7/1976 | Varney et al. | 272/131 X |

*Primary Examiner*—Richard J. Apley
*Assistant Examiner*—Robert W. Bahr
*Attorney, Agent, or Firm*—Varnum, Riddering, Schmidt & Howlett

[57] ABSTRACT

A portable exercising apparatus (10) adapted for use by a patient as a stand-alone unit includes an elongated tube (12) and a power slide (16) having a friction mounting on the tube (12). A force measuring mechanism (26) is coupled to the tube so as to measure external forces exerted in moving the tube (12) relative to a handle rod (24) partially received in one end of the tube (12). The mechanism (26) includes a gauge dial (32) with a pointer (34) coupled to a pinion gear (52). The pinion gear (52) engages a rack (64) mounted to a slide rod (56) received within the tube (12) and secured to the handle rod (24). Movement of the tube (12) relative to the slide rod (56), resulting from forces exerted on the power slide (16), causes rotation of the pinion gear (52) and dial pointer (34).

5 Claims, 12 Drawing Figures

PORTABLE EXERCISING APPARATUS WITH FORCE GAUGE

DESCRIPTION

1. Technical Field

The invention relates to exercise apparatus and, more particularly, to portable apparatus having means for measuring the relative magnitudes of forces exerted during exercise.

2. . Background Art

Various types of exercise equipment have been developed throughout history. This equipment is often directed to the exercising and strengthening of various muscle groups, such as the commonly known hand-held squeezing devices for exercising muscles of the hands and lower arm. However, more complex devices have been designed for use in strengthening and exercising other selected muscle groups. Historically, many of these devices used weights, springs or other preset resistances to movement. Such devices required the user to use only that amount of strength necessary to move the device through a weakest part of any movement.

Recently, other devices have been developed which offer resistance at a level adapting automatically to the user's abilities and providing resistance at a level substantially equal to the applied force throughout the entire range of an exercise stroke. Such equipment is typically referred to as "isokinetic" exercising equipment. Many isokinetic exercise devices are relatively complex, expensive and require frequent maintenance. In addition, many of these devices are relatively large and typically require positioning at a stationary fixed location.

Examples of isokinetic exercising equipment are disclosed in the Mattox U.S. Pat. No. 4,249,725 issued Feb. 10, 1981, and U.S. Pat. No. 4,385,760 issued May 31, 1983. More recently, a new isokinetic exercise device has the form of a cane which is relatively portable and capable of movement from location to location. This device is particularly advantageous for handicapped individuals.

It is also advantageous to employ force measuring mechanisms with exercising apparatus. For example, in the Varnery, et al. U.S. Pat. No. 3,971,255 issued July 27, 1976, an exercise bar includes a sleeve mounted to an elongated tube and slidable with respect to the tube. Bushings within the tube provide a friction slide between the sleeve and the tube, and handles are provided on the sleeve and at one end of the tube. Resistance of the sleeve on the tube is provided through a flat-headed pin and adjustably tensioned spring which exerts forces on the pin. A force measuring device is provided by a coil spring which is positioned between the outer end of the sleeve and an internal bushing. A gauge is mounted on the sleeve and indicates the amount of force applied by a user.

SUMMARY OF THE INVENTION

In accordance with the invention, a portable exercise apparatus for use by a human to exercise a variety of muscle and skeletal groups includes an elongated tube, a slide member slidably mounted on the tube, and means for providing frictional resistance to movement of the slide member along the tube. Force-measuring means are mounted to the tube to measure and visually indicate the frictional force between the slide member and the elongated tube. The force-measuring means includes a reactive member axially movable with respect to the tube, and means resiliently biasing the reactive member to a neutral position with respect to the tube. In accordance with the invention, the improvement includes a means between the elongated tube and the reactive member to translate relative linear movement between the tube and the reactive member to proportional rotation movement. The means to translate relative linear movement comprises a rack and pinion assembly.

The reactive member can comprise an elongated member at least partially received within one end of the tube. The reactive member is rigidly secured to a rack of the rack and pinion assembly. The rack and pinion assembly can include a pinion gear mounted to the tube and rotatably engaged with the rack.

The resilient biasing means can include compression spring means mounted within the tube to exert increasing resistance to relative movement of the tube and the member. The force-measuring means can also include spring-cup means positioned within the tube and slidable with respect thereto so as to support the rack and at least one end of the compression spring means.

The compression spring means can include first and second compression springs coaxially positioned within the tube. Axial movement of the elongated member in one direction relative to the tube causes compression of the first compression spring. Correspondingly, axial movement of the elongated member in an opposing direction relative to the tube causes compression of the second compression spring.

The force-measuring means can also include a spring cup slidably positioned within the tube, wherein the rack is mounted to the spring cup and the first compression spring extends axially within the tube. The first compression spring is secured at one end to the spring cup, and a slide rod extends axially through the spring cup and at least partially through the tube. The slide rod is secured at one end to the elongated member.

BRIEF DESCRIPTION OF THE DRAWINGS

The invention will now be described with reference to the drawings in which.

DETAILED DESCRIPTION

The principles of the invention are disclosed, by way of example, in a portable exercise apparatus 10 as depicted in FIGS. 1–4. The exercise apparatus 10 is adapted for use by individuals as a stand-alone unit to exercise various muscle/skeletal groups. The apparatus 10 is relatively simple in design, lightweight and portable, thereby particularly advantageous for use by handicapped individuals or other patients undergoing rehabilitative exercise therapy. As will be described in detail herein, the apparatus 10 is adapted to provide resistance to movement during an exercise stroke, thereby requiring strengthening forces to be exerted by the patient. In addition, the apparatus 10 includes means for measuring the forces exerted by the patient during exercise.

Figure 1:
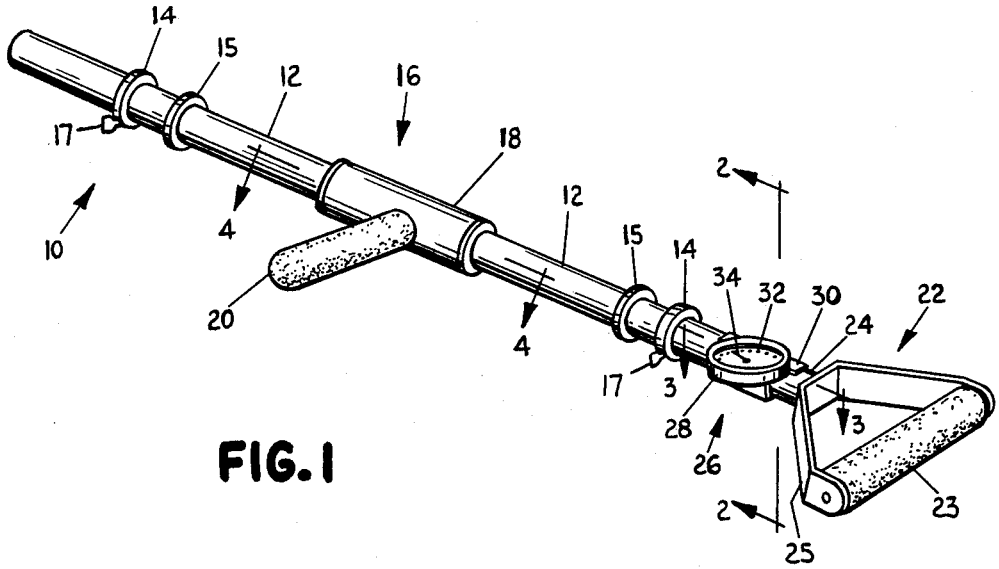
FIG. 1 is a perspective view of a portable exercise apparatus in accordance with the invention.

Referring specifically to FIG. 1, the portable exercise apparatus 10 includes an elongated outer tube 12 preferably constructed of a light weight but durable material. Mounted to the outer tube 12 are a pair of adjustable control rings 14 conventional in design and selectively positionable by the user along the axial length of the outer tube 12. Each of the control rings 14 includes a thumb-screw 17 to allow the user to secure rings 14 at selected positions along the radial outer surface of tube 12. A pair of lubrication rings 15 are mounted on outer tube 12 inwardly of control rings 14. The lubrication rings 15 can be made of leather or similar material, and impregnated with a lubricant.

Positioned between the adjustable control rings 12 and received on the outer tube 12 is a power slide 16 comprising a slidable sleeve 18 and a slide handle 20 radially extending from the sleeve 18. A friction mounting can be provided between the sleeve 18 and the elongated tube 12, so that the sleeve 18 is slidable along the tube 12, but with some degree of force required to generate the sliding movement. The friction mounting can provide for a frictional resistance directly proportional to the linear forces exerted by the user and applied to the sleeve 18 relative to the tube 12.

Figure 4:
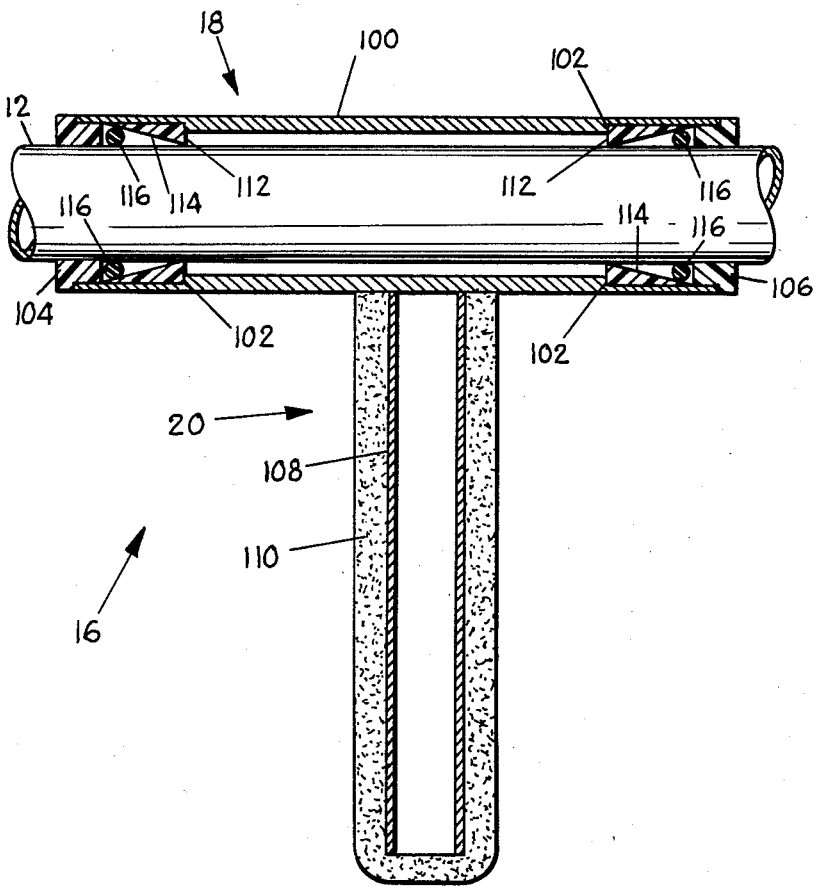
FIG. 4 is a sectional view of the portable exercise apparatus showing an exemplary friction mounting of the power slide to the tube and taken along lines 4—4 of FIG. 1.

An exemplary friction mounting arrangement having the aforedescribed features for an exercise mechnism is depicted in FIG. 4. Referring thereto, the sleeve 18 of the power slide 16 comprises a tubular member 100 which is concentric with the axis of the elongated tube 12. The inner diameter of the tubular member 100 is larger than the outer diameter of the elongated tube 12 so that an annular space is provided therebetween. Annular shoulders 102 are found in the inner surface of the tubular member 100. The tubular member 100 is supported on the elongated tube 12 by a pair of annular frictionless bushings 104 and 106. The bushings 104 and 106 can be maintained on the tubular member 100 by any suitable connecting means, such as a pair of set screws, staking or adhesive connections.

The slide handle 20 comprises a tubular handle member 108 which can be secured to the tubular member 100 by rigid means such as welds. Alternatively, the handle member 108 can be releasably secured to the tubular member 100. A rubber covering 110 is bonded to the tubular handle 108 to provide a firm gripping sur- face.

A pair of brake mechanisms 112 are mounted within the tubular member 100, adjacent to the frictionless bushings 104 and 106, and in abutting relation with the shoulders 102. The brake mechanisms 112 each comprise an elongated annular bushing, preferably made of plastic and having an internal ramped or conical surface 114. A pair of annular rubber "O" rings 116 are slidably mounted on the elongated tube 12, each fitting within a corresponding annular brake mechanism 112. The inner diameter of each O-ring 116 is only slightly smaller than the outer diameter of the elongated tube 12 so that there is some frictional resistance between each washer 116 and the elongated tube 12. Any suitable rubber or synthetic rubbery material can be used.

In operation, the user grips the handle 20 and moves the handle, for example, to the right as viewed in FIG. 4. The rubber covering 110 on the handle 20 provides a secure gripping surface. As the handle 20 is moved to the right as shown in FIG. 4, the frictional resistance between the O-ring 116 on the right and the elongated tube 12 causes the right-side O-ring 116 to ride up on the corresponding and adjacent ramp surface 14, thereby increasing the frictional resistance between the O-ring 116 and elongated tube 12. The extent of movement of the O-ring 116 and the extent of frictional forces between the O-ring 116 and the elongated tube 12 depends on the force applied to the handle 20. In other words, the harder the force, the greater the frictional resistance of the sleeve 18. Thus, the power slide 16 provides a varying kinematic resistance to movement along the elongated tube 12, the amount of frictional resistance being dependent on the amount of force applied to the power slide 16 with respect to the elongated tube 12.

During movement of sleeve 18 to the right as viewed in FIG. 4, the left-side O-ring 116 will move into abutting relationship with the corresponding bushing 104. In this position of the left-side O-ring 116 with respect to the surface 114 of corresponding brake mechanism 112, little or no frictional resistance is applied by the left-side O-ring 116 on the elongated tube 12. However, movement of the sleeve 18 to the left as viewed in FIG. 4 will cause the left-side O-ring 116 to ride up on ramp surface 114 of the corresponding left-side bracket mechanism 112. In the same manner as previously described for movement of sleeve 18 to the right, the amount of frictional resistance between sleeve 18 and tube 12 will be dependent on the amount of force applied to power slide 16.

Although FIG. 4 depicts a particular friction mounting between the power slide 16 and the elongated tube 12, other types of friction mounting arrangements can also be employed. It should be emphasized that the particular means for mounting a power slide 16 to the elongated outer tube 12 does not form the basis for the principal concepts of the invention described and claimed herein.

Positioned at one end of the elongated outer tube 12 is an end handle 22 comprising a hand grip 23 coupled to a handle rod 24 through an attached bracket 25. The end handle 22 provides a means for the patient to grip the exercise apparatus 10 with one hand maintaining a stationary position as will be subsequently described herein.

Mounted to the outer tube 12 adjacent the location of end handle 22 is a force measuring mechanism 26 as depicted in FIG. 1. Referring to FIG. 1 and particularly FIGS. 2 and 3, the force measuring mechanism 26 includes a circular gauge housing 28 rigidly mounted to the outer tube 12 by means of a gauge bracket mounting 30. The bracket mounting 30 includes an angled bracket 40 secured to the bottom of gauge housing 28 and one of two straight brackets 42 through screws 44. At the upper portion of the outer tube 12 as depicted on FIG. 2, the housing 28 is directly mounted to the outer tube 12 by means of screws 44 connected through a second straight bracket 42.

Mounted within the housing 28 and maintained stationary relative thereto is a dial face 32 having spaced apart markings to provide a visual indication of the forces exerted by the patient during use of the exercise apparatus 10. Rotatably mounted immediately above the dial face 32 is a dial pointer 34. The dial pointer 34 is secured to a gear shaft 50 by means of a screw 46 and stationary washer plate 48. The mounting of the dial pointer 34 above the dial face 32, and the mounting of gear shaft 50 through dial gauge housing 28 and dial face 32, allows the shaft 50 to rotate relative to the dial face 32, thereby correspondingly rotating dial pointer 34 to indicate magnitudes of externally exerted forces as described herein.

Figure 2:
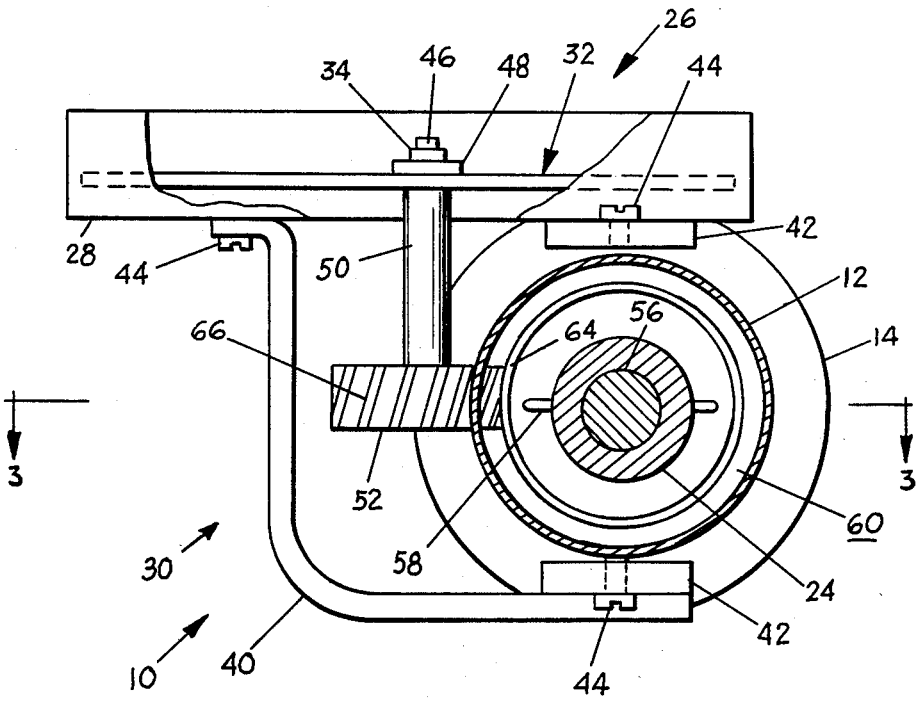
FIG. 2 is a sectional view of the portable exercise apparatus showing components of the force measuring mechanism and taken along lines 2—2 of FIG. 1.
Figure 3:
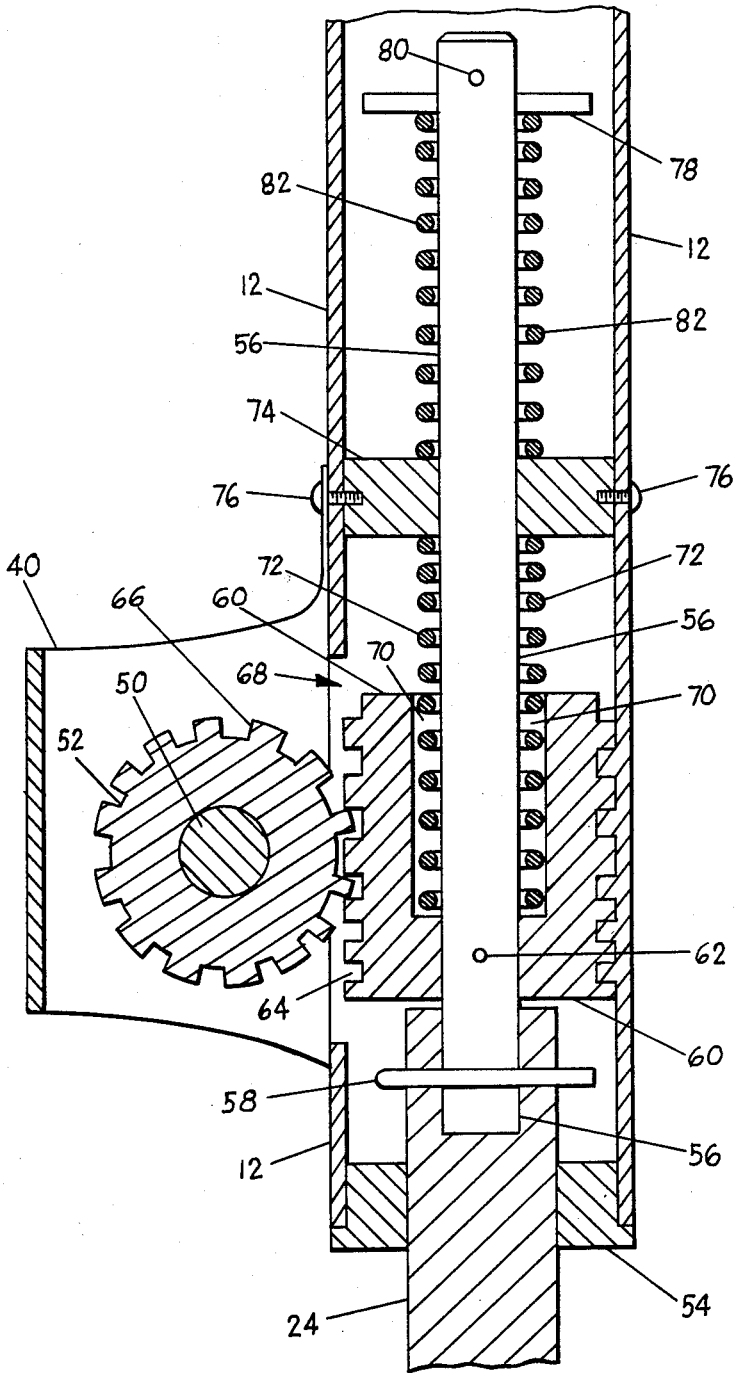
FIG. 3 is a sectional view of the portable exercise apparatus showing the force measuring mechanism taken along lines 3—3 of FIGS. 1 and 2.

Referring to FIGS. 2 and 3, gear shaft 50 extends downwardly relative to the position of outer tube 12 depicted in FIG. 2. Rigidly mounted to shaft 50 at its lower end is a pinion gear 52 having a series of gear teeth 66. The pinion gear teeth 66 extend into a slot 68 located in the radial surface of outer tube 12.

Referring particularly to FIG. 3, a stop and guide block 54 is mounted in the end of outer tube 12 adjacent the end handle 22. The handle rod 24 extends inwardly from end handle 22 into the outer tube 12 through the guide block 54. The end of handle rod 24 extending into outer tube 12 includes a recessed area conforming to the shape of a slide rod 56. One end of the slide rod 56 is rigidly secured to the handle rod 24 by means of a cotter pin 58 or other suitable connecting means. The slide rod 56 extends at least partially along the axial length of outer tube 12, is centrally positioned therein, and supported by means of a stationary guide block 74 rigidly secured to the outer tube 12 through screws 76.

Located within the outer tube 12 and intermediate the guide block 74 and the end of slide rod 56 received within handle rod 24 is a spring cup 60 as depicted in FIG. 3. The spring cup 60 includes a cylindrical aperture in which the slide rod 56 is axially received. Rod 56 is secured in a stationary position relative to spring cup 60 by means of a pin 62 or similar connecting means.

The spring cup 60 can be substantially cylindrical in shape and includes rack teeth 64. The rack teeth 64 are positioned within outer tube 12 adjacent the slot 68, and the pinion gear teeth 66 are positioned so as to engage the rack teeth 64.

As depicted in FIG. 3, the spring cup 60 includes a centrally located slot 70 open on one end and extending partially through the axial length of the spring cup 60. Mounted within the slot 70 and extending outwardly around the slide rod 56 to the guide block 74 is a compression spring 72. Located on the opposing surface of guide block 74 from the compression spring 72 is a second compression spring 82. Compression spring 82 is also positioned around the radial surface of slide rod 56 and supported at opposing ends by the guide block 74 and a washer 78 fixed in stationary position relative to the slide rod 56 by means of a roll pin 80 or similar securing means.

In operation, as the power slide 16 moves along the outer tube 12, the outer tube 12 will move axially with respect to slide rod 56 in direct proportion to the frictional force between the sleeve 18 and the outer tube 12. Movement of the slide rod 56 relative to the outer tube 12 will result in corresponding movement of the spring cup 60 relative to tube 12. Movement of spring cup 60 relative to tube 12 will cause rotational movement of the pinion gear 52 through engagement of the pinion gear teeth 66 with the rack teeth 64. Rotation of pinion gear 52 will cause corresponding rotation of dial pointer 34 coupled through gear shaft 50 as previously described.

The resistance of the movement of the slide rod 56 with respect to the outer tube 12 is directly proportional to the frictional force of the power slide 16 on the outer tube 12. As the slide rod 56 moves to the right relative to outer tube 12, the compression spring 72 will be increasingly compressed, thereby requiring increasing forces to continue movement of the spring cup 60 and slide rod 56 relative to tube 12. Similarly, as the slide rod 56 is moved to the left as viewed in FIG. 3 relative to outer tube 12, compression spring 82 will be compressed, thereby requiring increasing forces to provide further movement. Thus, the movement of the pointer 34 is proportional to the frictional force between the sleeve 18 and the outer tube 12.

An additional pointer (not shown) can be rotatably mounted on the gear shaft 50 or on the inside face of a cover (not shown) to indicate maximum force attained in a given direction. The additional pointer can be coupled to the dial pointer 34 so that it moves therewith, but only in one direction. Thus, the dial pointer 34 can move the additional pointer in one direction as force is applied to one direction to the power slide 18. When the force is released, the dial pointer 34 will return to zero, but the additional pointer will stay at the maximum value reached.

Exemplary exercises performed by a patient or user 90 with the portable exercise apparatus 10 are generally depicted in FIGS. 5–12. It should be noted that the magnitude of resistance required to move the power slide 16 with respect to the outer tube 12 can be decreased by providing lubrication on the tube 12 through the lubricating rings 15. Similarly, resistance can be increased by removing lubrication from the outer surface of tube 12, and variable resistance can be provided over a particular range of motion by selectively lubricating or removing lubrication from various portions of tube 12. Finally, it should also be noted that the adjustable control rings 14 provide a means for limiting the range of motion of sleeve 18 relative to outer tube 12. In addition, moving the control rings 14 inward so that motion of power slide 16 is blocked will allow isometric exercise and also isometric testing of muscle strength of the user.

Figure 5:
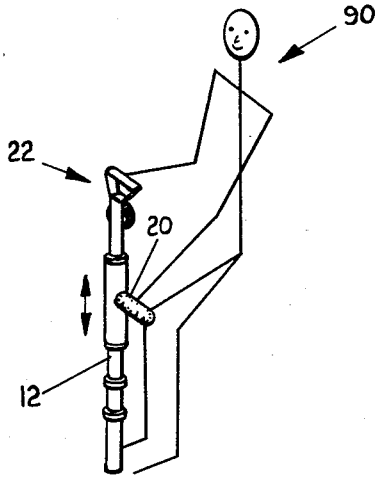
FIG. 5 depicts the use of the portable exercise apparatus shown in FIG. 1 for ankle plantar flexion.

Referring specifically to FIG. 5, the portable exercise apparatus 10 can be utilized to provide an exercise involving ankle plantar flexion. The patient 90, while maintaining a sitting position, holds the exercise apparatus 10 with one hand gripping the end handle 22 and the other hand gripping slide handle 20 of the power slide 16. The power slide 16 is positioned so that the slide 16 is initially maintained against the top of the knee area while the patient's heel is flat against a floor surface. The end handle 22 is maintained in a stationary position and the patient 90 raises his heel from the floor surface through a desired range of motion.

As the heel is raised, the power slide 16 correspondingly moves towards the end handle 22. Because of the frictional mounting arrangement between the power slide 16 and the outer tube 12, the outer tube 12 will move toward the end handle 22. Referring to FIG. 3, this particular exercise will result in the outer tube 12 moving to the left as viewed in FIG. 3, with the slide rod 56 maintaining a stationary position. As the outer tube 12 moves, pinion gear 50 will rotate through engagement of the rack teeth 64. Rotation of the pinion gear 52 will be in a counter clockwise direction as viewed in FIG. 3, and causes the dial pointer 34 to rotate, thereby resulting in a visual indication of the forces exerted by the patient 90 through movement of the dial pointer 34 relative to dial face 32.

Correspondingly, compression spring 72 will be compressed increasingly through movement of the guide block 74 relative to the the spring cup 60. Similarly, compression spring 82 will be unloaded, resulting from movement of guide block 74 further away from washer 78. Both of the springs 82 and 72 will be unloaded when the pointer 34 is at zero on the dial face 32. The structural relationship between spring cup 60, guide block 74 and washer 78 and the particular compression characteristics of compression springs 72 and 82 can be selected so as to provide a requisite amount of forces to be exerted during exercise.

As previously described, rotation of the patient's heel from the floor surface will provide an exercise for ankle plantar flexion. Preferably, the patient 90 should rotate the heel through a 40° range of motion to obtain full plantar flexion.

Figure 6:
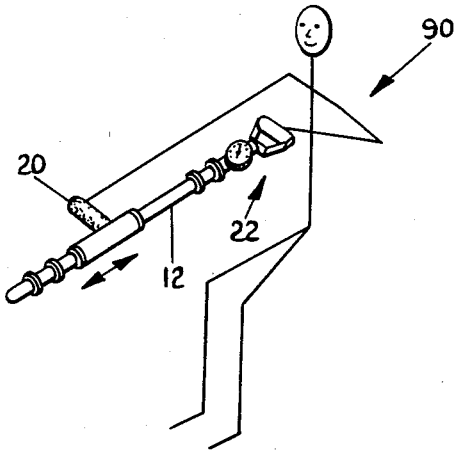
FIG. 6 depicts use of the portable exercise apparatus shown in FIG. 1 for scapular abduction and outward rotation.

FIG. 6 depicts another exemplary exercise using the portable exercise apparatus 10. This exercise is particularly adapted for shoulder therapy involving scapular abduction and outward rotation. Specifically, the patient 90 can mantain a standing, sitting or prone position. The end handle 22 of the exercise apparatus 10 is held in one hand against the patient's chest area. The patient's other hand is suitably positioned on the handle of power slide 16. The power slide 16 should be initially positioned on outer tube 12 so that the patient's arm is fully extended.

The patient 90 then exerts a forward movement of his shoulder to push the power slide 16 along outer tube 12 away from the end handle 22. Referring to FIG. 3, with the end handle 22 held in a stationary position, movement of the power slide 16 as depicted in FIG. 5 will result in outer tube 12 moving toward the right away from end handle 22. Accordingly, compression spring 82 is increasingly compressed as the guide block 74 moves toward the washer 78. With this exercise requiring shoulder movement in a forward direction by the patient 90, abduction of the scapula is provided.

Figure 7:
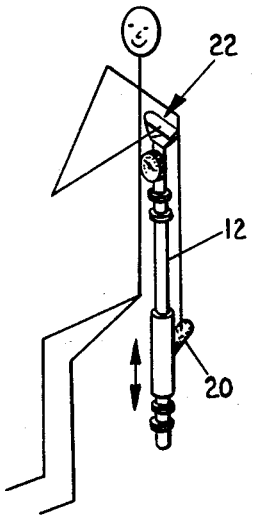
FIG. 7 depicts use of the portable exercise apparatus shown in FIG. 1 for scapula elevation.

In FIG. 7, an exemplary exercise providing scapula elevation is depicted. The patient 90 can remain in a standing or sitting position with the exercise apparatus 10 being held so that the outer tube 12 is in a vertical position. The end handle 22 is held in one hand by the patient 90 adjacent to the patient's opposite shoulder. The other hand is maintained on the slide handle 20 of power slide 16. In an initial position, the power slide 16 is positioned so that the patient's arm extending adjacent the outer tube 12 is in a fully extended position. Scapula elevation is provided by the patient pulling upwardly on power slide 16, with the arm remaining extended and the shoulder correspondingly being raised. This movement substantially corresponds to the patient exhibiting a "shrugging" action with his shoulder. With this exercise, the power slide 16 moves toward the end handle 22 in a manner similar to that described with respect to FIG. 5.

Figure 8:
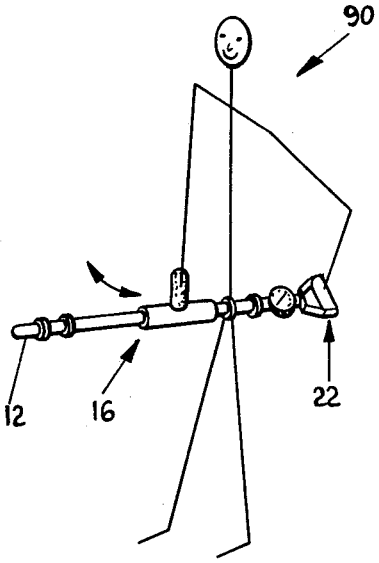
FIG. 8 depicts use of the portable exercise apparatus shown in FIG. 1 for shoulder flexion.

Shoulder flexion can be provided by use of the exercise apparatus 10 in the manner generally depicted in FIG. 8. For this exercise, the patient 90 maintains a standing position and grips the end handle 22 of the exercise apparatus 10 with one hand near the hip area, with the corresponding arm crossing over the body. The patient's other hand grips the handle 20 of power slide 16. The outer tube 12 of the exercise apparatus 10 is initially positioned at a substantially horizontal plane with the patient's arm gripping the power slide 16 in a downwardly extending position. With the end handle 22 maintained stationary, the patient 90 moves his arm in a forward direction, thereby resulting in an arc movement of the power slide 16, and corresponding flexion of the shoulder.

Figure 9:
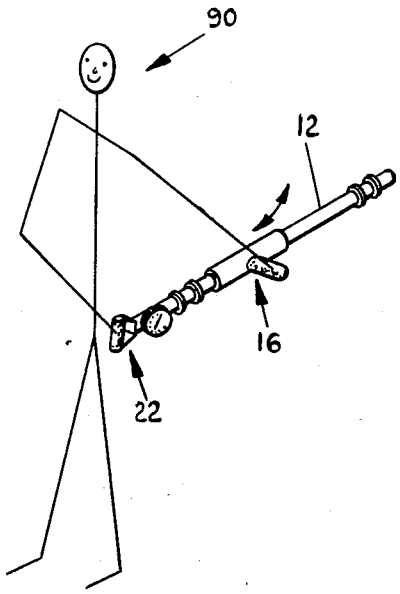
FIG. 9 depicts use of the portable exercise apparatus shown in FIG. 1 for shoulder extension.

An exercise to provide shoulder extension utilizing the portable exercise apparatus 10 is depicted in FIG. 9. In this exercise, the patient 90 remains in a standing position and grips the end handle 22 and power slide 16 in a manner similar to that depicted in FIG. 8. However, in contrast to the exercise shown in FIG. 8, the outer tube 12 of exercise apparatus 10 is initially maintained on a horizontal plane but extends rearwardly from the patient 90. With the patient 90 maintaining his arm gripping the power slide 16 in a fully extended position, shoulder extension is provided by moving the arm in a rearward direction, thereby moving the power slide 16 away from end handle 22. Substantial shoulder extension can be provided by moving the arm through an arc of up to 90° from the initial vertical position.

Figure 10:
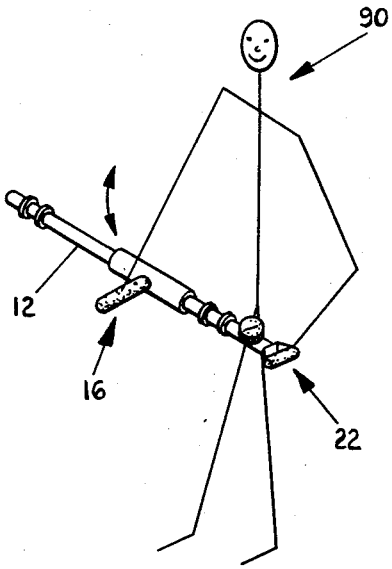
FIG. 10 depicts use of the portable exercise apparatus shown in FIG. 1 for shoulder horizontal abduction.

An exercise employing apparatus 10 to provide for shoulder horizontal abduction is depicted in FIG. 10. Specifically, the patient 90 maintains a standing position and grips the end handle 22 with one hand adjacent the abdominal area. The hand of the other arm grips the handle 20 of power slide 16 so that the patient's arm is fully extended and the power slide 16 is adjacent the patient's hip. With the outer tube 12 initially in a horizontal plane and extending laterally from the patient 90, the patient 90 maintains the end handle 22 in a stationary position and moves his arm gripping the power slide 16 sideways up to the patient's shoulder level and back again.

Figure 11:
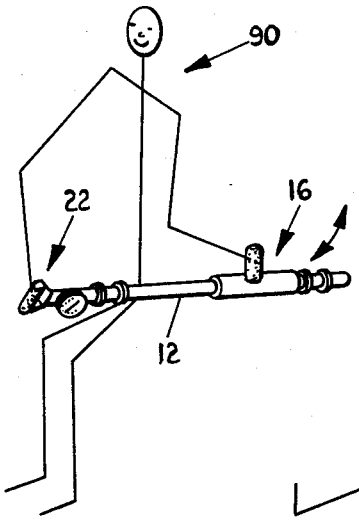
FIG. 11 depicts use of the portable exercise apparatus shown in FIG. 1 for shoulder lateral and medial rotation.

An additional shoulder exercise employing apparatus 10 can be utilized to provide lateral and medial rotation. As depicted in FIG. 11, with the patient 90 maintaining a sitting position (the patient can also maintain a standing position), the end handle 22 is held in one arm adjacent the abdominal area. The patient's other arm is utilized to grip the power slide 16 in a manner so that the other arm is bent, with the patient's elbow at his side. Additionally, the patient's forearm is maintained in a substantially horizontal plane with the outer tube 12 initially extending laterally from the patient 90. To perform the exercise, the patient 90 rotates his forearm through a range of motion up to 90° from the initial position, while maintaining the horizontal plane of the forearm. During initial forearm rotation, the power slide 16 is moved toward the end handle 22. This particular type of exercise will provide lateral and medial rotation of the shoulder.

Figure 12:
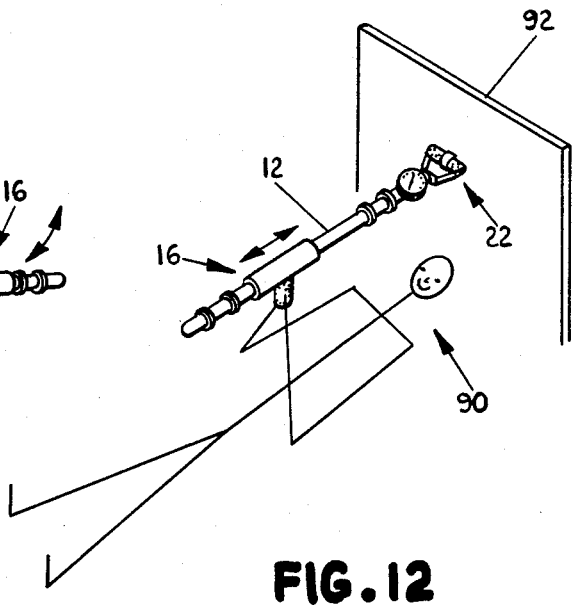
FIG. 12 depicts use of the portable exercise apparatus shown in FIG. 1 while the patient is lying in a prone position to provide shoulder flexion involving pectoralis major and deltoid muscles.

Another exemplary exercise employing the exercise apparatus 10 can be utilized to provide flexion of the shoulder, whereby the flexion involves the pectoralis major and deltoid muscles. As shown in FIG. 12, the patient 90 maintains a prone position on his back with both arms bent at the elbows. A stationary board 92, such as the headboard of a bed, is positioned rearward of the patient's head and utilized to rigidly secure the end handle 22. Connection between handle 22 and board 92 can be made by any conventional connecting means. The end handle 22 is secured to the board 92 at a location so that the outer tube 12 is maintained in substantially a horizontal plane with the patient flexing his arms at the elbows and gripping the power slide 16 in both hands as depicted in FIG. 12. With the patient 90 maintaining his torso in a substantially stationary position, he moves the power slide 16 alternately toward and away from the end handle 22. Movement of the power slide 16 away from handle 22 will cause the arms to be extended, while movement of power slide 16 toward handle 22 will cause greater arm flexure. This exercise provides flexure of a variety of shoulder-associated muscles, including the pectoralis major and deltoid muscles.

Although a variety of exercises employing portable exercise apparatus 10 in a stand-alone configuration have been described herein and depicted in FIGS. 5–12, numerous other exercises employing apparatus 10 fall within the scope of use of the invention. For example, one configuration to exercise the deltoid, pectoralis major and abdome muscles can be achieved by having the patient 90 maintain the end handle 22 in a stationary position held between the patient's legs adjacent the groin area. The outer tube 12 can extend upwardly at a forward angle, with the patient 90 gripping the handle 20 of power slide 16 in both hands, with both arms fully extended at substantially a shoulder level. To exercise the appropriate muscles, the patient 90 initially pulls downward on the power slide 16 while maintaining the arms in a fully extended position. After reaching a downward position limited by one of the adjustable control rings 14, the patient can then continue the exercise by pulling upward on power slide 16, again maintaining the arms in a fully extended configuration.

Numerous other exercises similar to those described above and employing the portable exercise apparatus 10 can be utilized by the patient 90 in accordance with the invention. During performance of each of these exercises, the patient 90 can grip the power slide 16 and end handle 22 in a manner so that the dial face 32 of force measuring mechanism 26 is visually accessible to the patient 90, thereby providing a relative numerical indication of forces exerted on the apparatus 10 during exercise. The dial face is easily visible throughout the full scope of exercises, making it easier to see the force applied to the power slide.

Furthermore, the principles of the invention are not limited to the specific relative configuration of the various components of portable exercise apparatus 10 as described herein. For example, the positioning of the force measuring mechanism 26 can be moved to various locations relative to the ends of the elongated tube 12. Further, the means for converting the relative linear motion between the outer tube 12 and the rod 56 can be a friction drive mechanism or a cable wheel mechanism. In a friction drive, a wheel with an outer rubber surface would replace the pinion gear 52 and a friction surface would replace the rack teeth 64. In a cable wheel mechanism, a pulley wheel would replace the pinion gear and a cable would be wound 360° around the pulley. The ends of the cable would be secured to the ends of spring cup 60 and rack teeth 64 would be eliminated. It will be apparent to those skilled in the art that modifications and other variations of the above-described illustrative embodiment of the invention may be effected without departing from the spirit and scope of the novel concepts of the invention.

The embodiments of the invention in which an exclusive property of privilege is claimed are defined as follows:

1. In a portable exercise apparatus for use by a human to exercise a variety of muscles and skeletal groups and comprising an elongated tube; a slide member slidably mounted on said elongated tube; means providing frictional resistance to movement of the slide member along the elongated tube; force-measuring means mounted to said elongated tube to measure and visually indicate the frictional force between the slide member and the elongated tube, the improvement wherein the force-measuring means comprises:

a reactive member axially movable with respect to the elongated tube and at least partially received within the elongated tube;

means within the elongated tube resiliently biasing the reactive member to a neutral position with respect to the elongated tube;

a rotatable force indicator;

a rck and pinion assembly comprising a pinion gear mounted to the tube and a rack rigidly secured to the reactive member within the elongated tube and engageable with the pinion gear, whereby relative linear movement between the slide member and the tube resulting from forces exerted by the human is translated through the rack and pinion assembly into proportional rotational movement of the force measurement indicator visible to the human.

2. A portable exercise apparatus in accordance with claim 1 wherein:

the resilient biasing means comprises compression spring means mounted within the elongated tube for exerting increasing resistance to relative movement of the tube and reactive member; and the force-measuring means further comprises spring cup means positioned within the tube and slidable with respect thereto for supporting the rack and at least one end of the compression spring means.

3. A portable exercise apparatus in accordance with claim 2 wherein the compression spring means comprises first and second compression springs coaxially positioned within the elongated tube, and wherein axial movement of the reactive member in one direction relative to the tube causes compression of the first compression spring, and axial movement of the reactive member in an opposing direction relative to the tube causes compression of the second compression spring.

4. A portable exercise apparatus in accordance with claim 3 wherein the force-measuring means further comprises:

a spring cup slidably positioned within the elongated tube, wherein the rack is mounted to the spring cup and the first compression spring extends axially within the elongated tube and is secured at one end to the spring cup, and a slide rod extending axially through the spring cup at least partially through the tube and secured at one end to the reactive member.

5. A portable exercise apparatus in accordance with claim 1 and further comprising a pair of adjustably mounted locking rings on the elongated tube so as to selectively lock the slide member relative to the tube to provide isometric exercises.

* * * * *